US007670276B2

(12) United States Patent
Fujimoto et al.

(10) Patent No.: US 7,670,276 B2
(45) Date of Patent: Mar. 2, 2010

(54) DECANTER TYPE CENTRIFUGAL SEPARATOR WITH TORQUE TRANSMISSION MECHANISM

(75) Inventors: Koji Fujimoto, Tokyo (JP); Jun Ohashi, Tokyo (JP)

(73) Assignee: Tomoe Engineering Co., Ltd., Tokyo (JP)

( * ) Notice: Subject to any disclaimer, the term of this patent is extended or adjusted under 35 U.S.C. 154(b) by 147 days.

(21) Appl. No.: 11/990,764

(22) PCT Filed: Aug. 26, 2005

(86) PCT No.: PCT/JP2005/015569

§ 371 (c)(1),
(2), (4) Date: Feb. 21, 2008

(87) PCT Pub. No.: WO2007/023566

PCT Pub. Date: Mar. 1, 2007

(65) Prior Publication Data

US 2009/0233781 A1 Sep. 17, 2009

(51) Int. Cl.
*B04B 1/20* (2006.01)
*B04B 9/14* (2006.01)

(52) U.S. Cl. ..... 494/53; 494/82; 494/84

(58) Field of Classification Search ..... 494/50–54, 494/82, 84; 210/144
See application file for complete search history.

(56) References Cited

U.S. PATENT DOCUMENTS

| | | | | |
|---|---|---|---|---|
| 3,606,143 | A * | 9/1971 | Stallmann | 494/39 |
| 3,685,722 | A * | 8/1972 | Nichols, Jr. | 494/53 |
| 4,069,966 | A * | 1/1978 | Crosby et al. | 494/53 |
| 4,069,967 | A * | 1/1978 | Crosby et al. | 494/53 |
| 4,070,290 | A * | 1/1978 | Crosby | 210/91 |
| 5,120,298 | A * | 6/1992 | Jager | 494/53 |
| 5,197,939 | A * | 3/1993 | Cederkvist et al. | 494/53 |
| 2009/0233781 | A1 * | 9/2009 | Fujimoto et al. | 494/53 |

FOREIGN PATENT DOCUMENTS

| | | | |
|---|---|---|---|
| JP | 59-92047 | A | 5/1984 |
| JP | 62-4459 | A | 1/1987 |
| JP | 2005334715 | A * | 12/2005 |
| WO | 2007/023566 | A1 * | 3/2007 |

* cited by examiner

*Primary Examiner*—Charles E Cooley
(74) *Attorney, Agent, or Firm*—Kubotera & Associates, LLC

(57) ABSTRACT

A decanter type centrifugal separator includes a torque transmission mechanism with enhanced effect of absorbing a torsional vibration. The decanter type centrifugal separator (10) includes a bowl (20); a screw conveyor (40) disposed in the bowl (20); a processed liquid feed portion (15); a separated liquid discharge port (81); a solid discharge port (82); a drive portion (71); and a differential gear unit (50) for generating a difference in speeds between the bowl (20) and the screw conveyor (40). A torque transmission mechanism (60, 61) includes an elastic damping member (67) for absorbing the torsional vibration of the screw conveyor (40).

2 Claims, 10 Drawing Sheets

Coil spring tight clearance

Coil spring tight clearance

Coil spring tight clearance

DECANTER TYPE CENTRIFUGAL SEPARATOR WITH TORQUE TRANSMISSION MECHANISM

TECHNICAL FIELD

The present invention relates to a decanter type centrifugal separator for use in separation and dehydration treatment of crystalline particles, such as those of PVC (polyvinyl chloride), terephthalic acid, and the like, in the chemical industry, and in separation and dehydration treatment of starch ground milk, and the like, in the food industry.

BACKGROUND ART

In a conventional decanter type centrifugal separator 100 shown in FIG. 10, during separation and dehydration treatment of crystalline particles, such as those of PVC (polyvinyl chloride), terephthalic acid, or the like, or starch ground milk, or the like, when a throughput thereof increases during the conveyance and dehydration treatment of centrifugally precipitated particles (solid) along an axial direction thereof through a minute difference in speeds between a bowl 120 and a screw conveyor 140 disposed therein, chattering (torsional self-excited vibration) of the screw conveyor 140 is generated between the bowl 120 and a tip of a screw conveyor flight 142 through the treatment substances. As a result, there may be problems including damage of an internal gear due to an impact load (torque) being imposed on a differential gear unit 150, and a crack in a stock solution feed hole part 144 at 45 degrees due to a torsion of a screw conveyor cylindrical hub 141 (boss). Accordingly, the throughput of the conventional decanter type centrifugal separator 100 is restricted to less than approximately half of an intended design maximum treatment capacity thereof.

To eliminate such problems, proposals have been disclosed in, for example, U.S. Pat. No. 4,069,967 (Jan. 24, 1978), U.S. Pat. No. 4,069,966 (Jan. 24, 1978), and U.S. Pat. No. 3,685,722 (Aug. 22, 1972). Apparatuses disclosed in the references provide flexibility in a direction of rotation on a side of a differential gear unit in order to absorb torsional self-excited vibrations. However, plays may be created in the differential gear unit or in connection parts at both ends of a drive force transmission shaft disposed between the differential gear unit and a screw conveyor. As a result, it is difficult to absorb the torsional vibrations generated in the conveyor at each transmission part.

More specifically, in U.S. Pat. No. 4,069,967, a torsion bar, or the like, is mounted to a pinion gear shaft on an input side of the differential gear unit for absorbing the torsional vibration. Although maintaining spring characteristics, the torsion bar itself has an extremely small damping factor. Accordingly, it is insufficient for absorbing the torsional vibration. Further, the apparatus is mounted to the pinion gear shaft on the input side of the differential gear unit. Accordingly, it is easily expected that backlashes (plays) of the respective gears constituting a drive force transmission path in the differential gear unit, or plays of, for example, spline teeth of connection parts at both ends of a transmission shaft between the differential gear unit and a screw conveyor may accumulate. As a result, the effect of absorbing the torsional vibration generated in the conveyor in each transmission part may decrease.

In U.S. Pat. No. 4,069,966, a torsion bar is mounted to a pinion gear shaft on an input side of a differential gear unit in the same way as above. Further, as an auxiliary mechanism, a cantilever torsion bar tip part on the pinion gear shaft is immersed in viscous liquid to improve a damping factor for absorbing the torsional vibration. However, similar to the apparatus above, the apparatus is mounted to the pinion gear shaft on the input side of the differential gear unit. Accordingly, it is easily expected that backlashes (plays) of the respective gears constituting a drive force transmission path in the differential gear unit, or plays of, for example, spline teeth of connection parts at both ends of the transmission shaft between the differential gear unit and a screw conveyor may accumulate. As a result, the effect of absorbing the torsional vibration may decrease.

In U.S. Pat. No. 3,685,722, an output shaft side (a screw conveyor side) of a differential gear unit is provided with flexibility in a direction of rotation for absorbing the torsional self-excited vibration. However, a drive force is transmitted through connection parts at both ends of a transmission shaft between the differential gear unit and a screw conveyor. Accordingly, it is easily expected that plays of, for example, spline teeth of connection parts at both ends of the transmission shaft may accumulate. As a result, the effect of absorbing the torsional vibration may decrease. In addition, basically, a normal coil spring is combined with a leaf spring to provide the flexibility. Accordingly, it is supposed that a damping factor is low, and the effect of absorbing the torsional vibration is low.

DISCLOSURE OF THE INVENTION

However, in the prior art, flexibility in the direction of rotation is provided on the differential gear unit side as a measure against the torsional self-excited vibration. The torsion bar, or the like, is mounted to the pinion gear shaft on the input side of the differential gear unit or on the output shaft side (the screw conveyor side) of the differential gear unit. Accordingly, there is a possibility that the backlashes (plays) of the respective gears constituting the drive force transmission path in the differential gear unit, or the plays of, for example, the spline teeth of the connection parts at both ends of the transmission shaft between the differential gear unit and the screw conveyor may accumulate. As a result, the effect of absorbing the torsional vibration may decrease.

An object of the present invention is to provide a decanter type centrifugal separator. The decanter type centrifugal separator of the present invention includes a torque transmission mechanism, in which a drive transmission shaft between a differential gear unit and a screw conveyor has a joint part having flexibility on a screw conveyor side in a direction of rotation thereof during transmission of drive force for, thereby increasing torsional vibration absorbing effect through a high damping factor. In separation and dehydration treatment of crystalline particles, such as those of PVC (polyvinyl chloride), terephthalic acid, or the like, or starch ground milk, or the like, when a throughput increases, chattering (torsional self-excited vibration) of a screw conveyor drive mechanism is transmitted from a bowl to the differential gear unit, and from the differential gear unit to the screw conveyor through a drive transmission shaft. With the decanter type centrifugal separator of the present invention, it is possible to effectively absorb the torsional vibration through the high damping factor.

The subject matters of the present invention to achieve the above purpose are disclosed in the following respective aspects of the present invention:

According to a first aspect of the present invention, a decanter type centrifugal separator includes a bowl having a cylindrical part, a conical part, a separated liquid discharge dam part, and a dewatered solid discharge port; a screw conveyor disposed in the bowl being arranged coaxially with the bowl for axially conveying sedimentation solid, and capable of rotating at a speed different from that of the bowl; a processed liquid feed means; a separated liquid discharge port; a solid discharge port; a drive means; and a differential gear unit for generating a difference in speeds between the bowl and the screw conveyor.

Further, a torque transmission mechanism is included. The torque transmission mechanism is provided with an elastic damping member as a receiver of drive force transmission load on a torque transmission surface of a joint flange part formed in a joint part of a drive transmission shaft as a source of torsional vibration on a side of the screw conveyor between the differential gear unit and the screw conveyor in order to provide flexibility in a direction of rotation and an effect of damping with respect to a torsional self-excited vibration in small angles in forward and backward directions generated during transmission of drive force. Accordingly, the torsional self-excited vibration of the screw conveyor generated during conveyance of treatment substances due to a minute difference in the speeds between the bowl and the screw conveyor is absorbed.

According to a second aspect of the present invention, the elastic damping member is formed of coil springs.

The torque transmission mechanism included in the joint part of the drive transmission shaft on the side of the screw conveyor between the differential gear unit and the screw conveyor has a driven side joint flange part having a U-shaped section in which a plurality of coil spring accommodating spaces and coil spring inside diameter supporting shafts are arranged on a circumferential pitch circle thereof, and a drive side flange part disposed in a middle space of the driven side joint flange part and having a plurality of outside diameter holding holes for the coil springs on the same circumferential pitch circle. Each of the coil springs is formed of a wire segment having a rectangular section or having flat planes at least at both sides thereof in a coil axial direction. Further, each of the coil springs has a shape of a barrel-shaped coil which is convex at a middle portion thereof in the axial direction, or of a hyperboloid-shaped coil which is concave at the middle portion thereof. Accordingly, by adjusting a clearance between an outer diameter of the coil spring inside diameter supporting shafts in the driven side joint flange part having the U-shaped section and an inner diameter of the coil spring outside diameter holding holes in the drive side flange part, and by adjusting a coil spring tight clearance of a middle space of the driven side joint flange part in the axial direction, whereby flexibility in the direction of rotation is provided, and the torsional self-excited vibration in the small angles in the forward and backward directions generated during the transmission of the drive force is damped with frictional energy generated through axial direction surface contact between the wire segments of the coil springs under a lateral load imposed on the coil springs during the torque transmission.

According to a third aspect of the present invention, an entire interior of the torque transmission mechanism formed in the joint part of the drive transmission shaft on the side of the screw conveyor between the differential gear unit and the screw conveyor is immersed in a high viscosity liquid or a high viscosity substance to increase a degree of damping of the self-excited vibration.

BEST MODE FOR CARRYING OUT THE INVENTION

Hereinbelow, with reference to the drawings, various exemplary embodiments of the present invention will be described.

Figure 1:
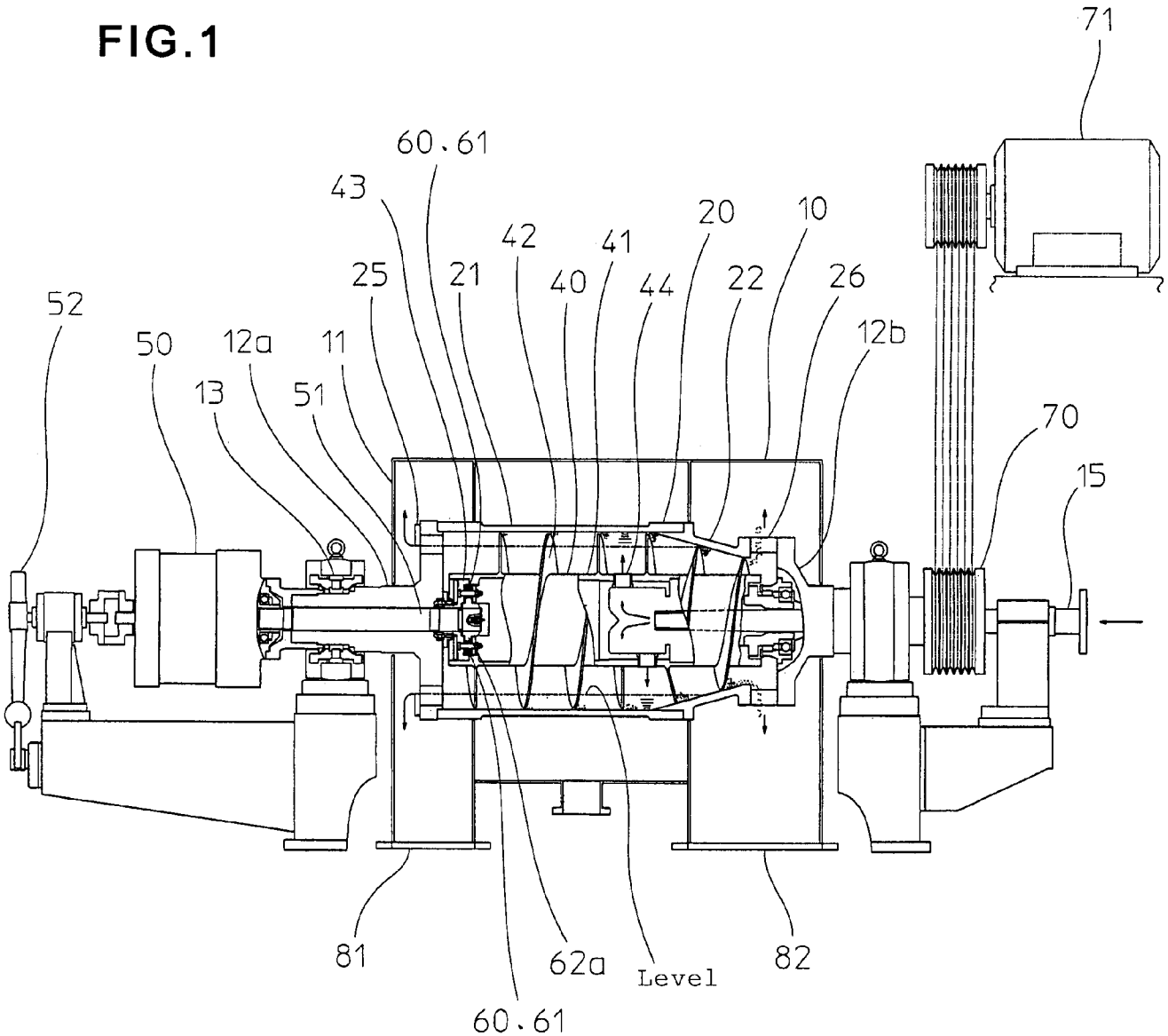
FIG. 1 is a schematic view illustrating an entire configuration of a decanter type centrifugal separator pertaining to an embodiment of the present invention.
Figure 2:
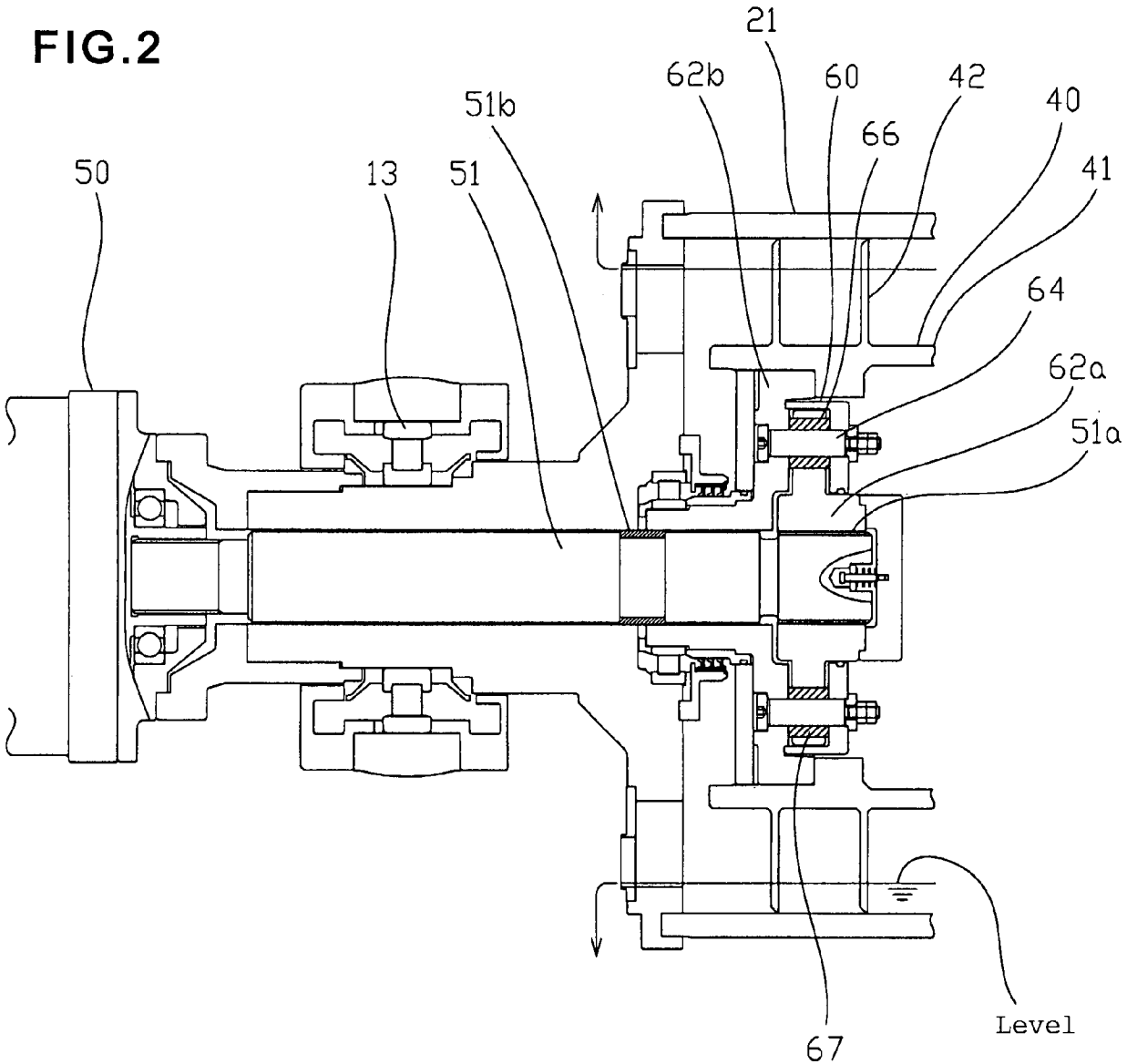
FIG. 2 is an explanatory drawing illustrating a critical portion of a decanter type centrifugal separator pertaining to a first embodiment of the present invention.

FIG. 1 and FIG. 2 show a first embodiment of the present invention.

A decanter type centrifugal separator 10 comprises a bowl 20 having a cylindrical part 21, a conical part 22, a separated liquid discharge dam part 25, and a dewatered solid discharge port 26; a screw conveyor 40 for axially conveying sedimentation solid that is inserted into the bowl 20, and is arranged so that it is coaxial with the bowl 20, and can be rotated at a speed different from that of the bowl 20, as well as processed liquid feed means 15; a separated liquid discharge port 81; a solid discharge port 82; drive means 71; and a differential gear unit 50 which produces a difference in speed between the bowl 20 and the screw conveyor 40.

The bowl 20 of the decanter type centrifugal separator 10 has an inside diameter of 740 mm, and the bowl 20 is rotated at a speed of 1700 to 2800 $min^{-1}$ for a centrifugal force of 1200 G to 3200 G, while an internal screw conveyor flight 42 is rotated at a speed of 1620 to 2760 $min^{-1}$ in the same direction as the bowl 20, slower than the bowl 20 by a difference in speed of 40 to 80 $min^{-1}$ or so, whereby the solid precipitated in the liquid inside the bowl 20 can be axially conveyed. The solid is further drawn up from the liquid by the screw conveyor flight 42 in the conical part 22, and thus it is dehydrated in the course of being axially conveyed, and is continuously discharged to the outside of the decanter type centrifugal separator 10 through the solid discharge port 82.

On the other hand, the separated liquid which has been separated from the precipitated particles is caused to spirally flow between segments of a screw conveyor flight 42 in the bowl 20 in the direction as opposed to that of flow of the sedimentation solid, flowing over a separated liquid discharge dam part 25 to be continuously discharged to the outside of the decanter type centrifugal separator 10 through the separated liquid discharge port 81.

For example, in case where the decanter type centrifugal separator 10 is operated at a stock solution feed rate of 40

$m^3$/h for a throughput of solid of PVC (polyvinyl chloride), or the like, of 10 tons/h for separation and dehydration treatment of solid of PVC, or the like, which can easily cause chattering (torsional self-excited vibration), a planetary gear drive is used as the differential gear unit 50 for producing a difference in speed between the bowl 20 and the screw conveyor 40 in general, and transmission torque to the screw conveyor 40 for conveying solid of PVC, or the like, is typically at 500 kg·m or so, however, if the screw conveyor has a torsional self-excited vibration, the transmission torque will be increased to 2 to 3 times the normal transmission torque or higher at peak, thus in order to accommodate such an increase, it would be necessary to enhance the capacity of the actually loaded differential gear unit 50 to as high as 1500 to 2000 kg·m.

In the decanter type centrifugal separator 10 including the bowl 20 having an inside diameter of 740 mm, an elastic damping member 67, such as a hard rubber, or the like, is disposed as a receiver of drive force transmission load on the torque transmission surface 66 of a joint flange part 62*a*, 62*b* formed in the joint part 43 as a possible source of torsional vibration generation on the side of the screw conveyor 40 of a drive transmission shaft 51 between the differential gear unit 50 and the screw conveyor 40, as a measure against torsional self-excited vibration of the screw conveyor 40 that can occur between the bowl 20 and the tip of a screw conveyor flight 42 through the treatment substances, such as PVC crystalline particles, or the like, especially at the time of operation under high load or for increased throughput, when the centrifugally precipitated particles (solid) are axially conveyed and dehydrated on the basis of the above-mentioned minute difference in speed of 40 to 80 $min^{-1}$ or so between the bowl 20 and the screw conveyor 40 inside it, whereby a torque transmission mechanism 60 is achieved which provides flexibility in the direction of rotation, and affords the effect of damping the torsional self-excited vibration in small angles in the forward and backward directions generated during transmission of drive force.

Because the torque transmission mechanism 60 is provided within the inside diameter of the screw conveyor hub 41, the size thereof is restricted, however, the diameter can be approximately 400 mm, and the axial length be 300 mm or so. The elastic damping member 67 disposed is made of any material selected from a wide variety of hard rubbers, such as urethane rubber, nitrile rubber, Viton (r), and EPDM, for example, and it has a rubber hardness of 60 to 85 degree. The operating temperature therefor is typically 100 degree C. or below.

Further, besides the above-mentioned hard rubbers, resin materials having an elasticity can also be used.

Incorporation of the torque transmission mechanism 60 will eliminate the occurrence of torsional self-excited vibration, and torque fluctuation with peaks, thus the requirement for capacity of the actually loaded differential gear unit 50 will be reduced to as low as 600 to 800 kg·m, which corresponds to the normal transmission torque.

Figure 3:
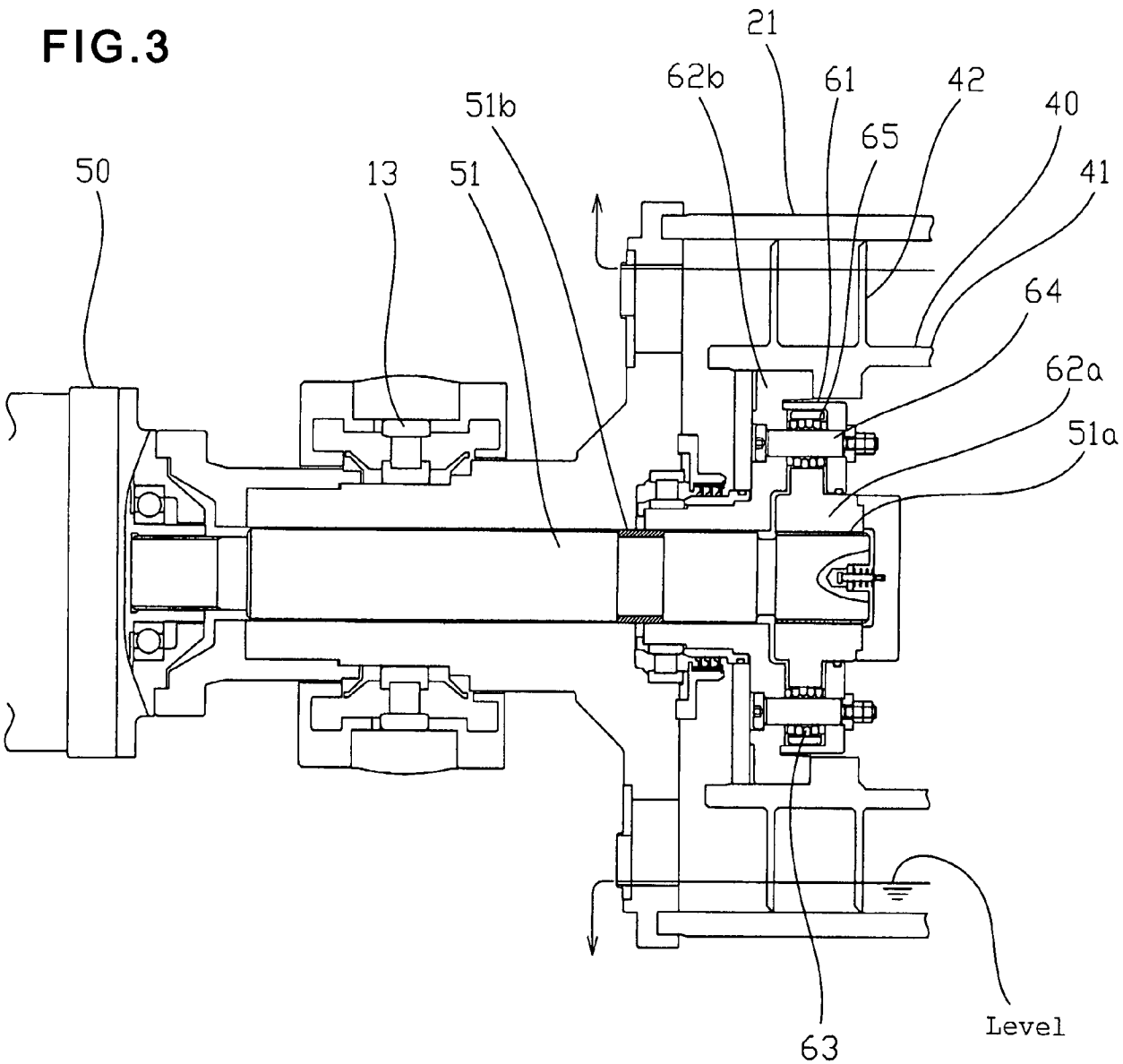
FIG. 3 is an explanatory drawing illustrating a critical portion of a decanter type centrifugal separator pertaining to a second embodiment of the present invention.

FIG. 3 shows a second embodiment of the present invention.

The same components as those in the first embodiment will be provided with the same reference numerals.

The bowl 20 of the decanter type centrifugal separator 10 pertaining to the present embodiment also has an inside diameter of 740 mm, and the bowl 20 is rotated at a speed of 1700 to 2800 $min^{-1}$ for a centrifugal force of 1200 G to 3200 G, while an internal screw conveyor flight 42 is rotated at a speed of 1620 to 2760 $min^{-1}$ in the same direction as the bowl 20, slower than the bowl 20 by a difference in speed of 40 to 80 $min^{-1}$ or so, whereby the solid precipitated in the liquid inside the bowl 20 can be axially conveyed. The solid is further drawn up from the liquid by the screw conveyor flight 42 in the conical part 22, whereby it is dehydrated in the course of being axially conveyed, and is continuously discharged to the outside of the decanter type centrifugal separator 10 through the solid discharge port 82.

On the other hand, the separated liquid which has been separated from the precipitated particles is caused to spirally flow between segments of a screw conveyor flight 42 in the bowl 20 in the direction as opposed to that of flow of the sedimentation solid, flowing over a separated liquid discharge dam part 25 to be continuously discharged to the outside of the decanter type centrifugal separator 10 through the separated liquid discharge port 81.

For example, in case where the decanter type centrifugal separator 10 is operated at a stock solution feed rate of 40 m3/h for a throughput of solid of PVC (polyvinyl chloride), or the like, of 10 tons/h for separation and dehydration treatment of solid of PVC, or the like, which can easily cause chattering (torsional self-excited vibration), a planetary gear drive is used as the differential gear unit 50 for producing a difference in speed between the bowl 20 and the screw conveyor 40 in general, and transmission torque to the screw conveyor 40 for conveying solid of PVC, or the like, is typically at 500 kg·m or so, however, if the screw conveyor has a torsional self-excited vibration, the transmission torque will be increased to 2 to 3 times the normal transmission torque or higher at peak, thus in order to accommodate such increase, it would be necessary to enhance the capacity of the actually loaded differential gear unit 50 to as high as 1500 to 2000 kg·m.

Figure 4:
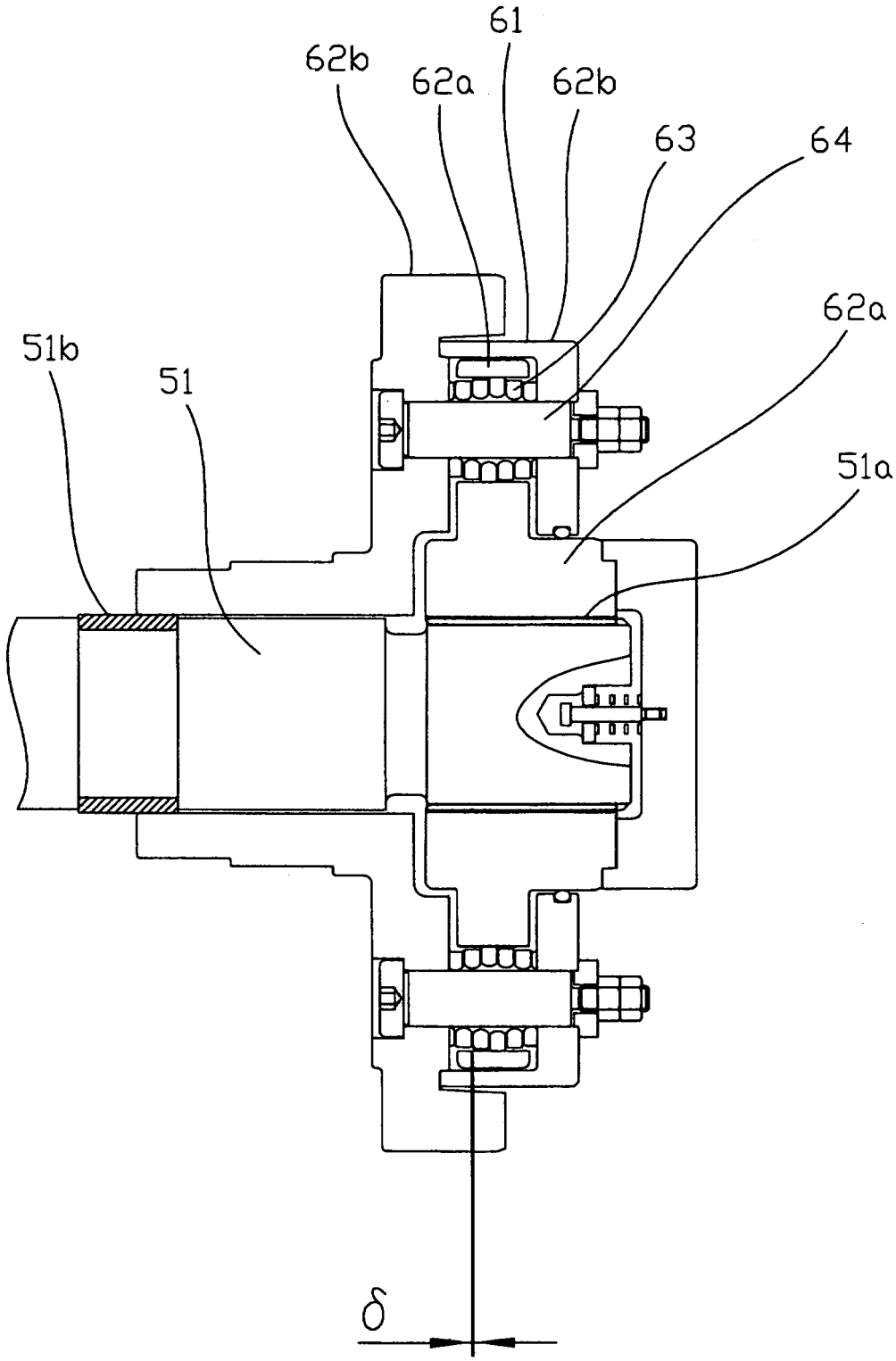
FIG. 4 is a partial side view illustrating a torque transmission mechanism shown in FIG. 3 in detail.
Figure 5:
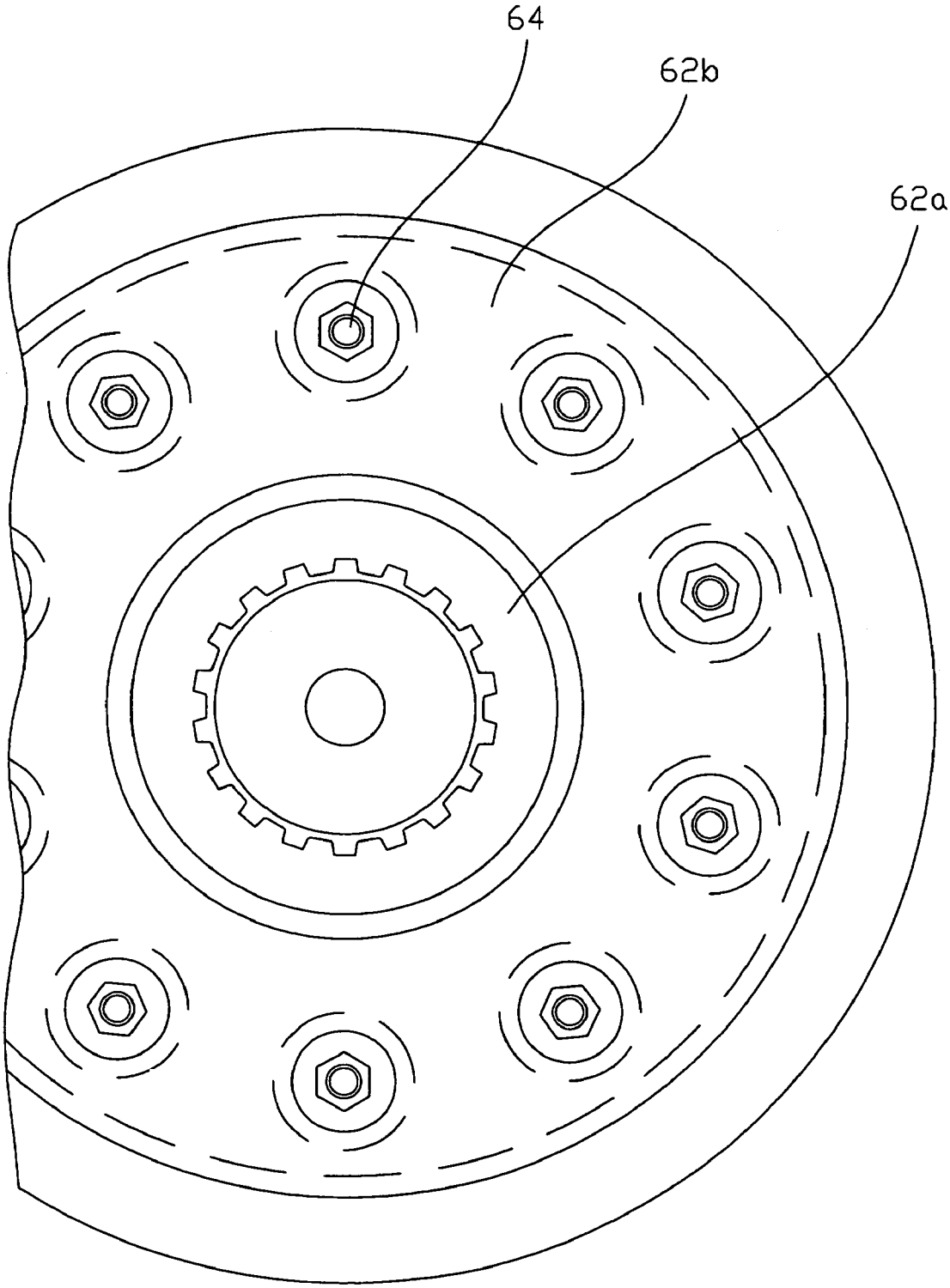
FIG. 5 is a partial front view illustrating the torque transmission mechanism shown in FIG. 3 in detail.
Figure 6:
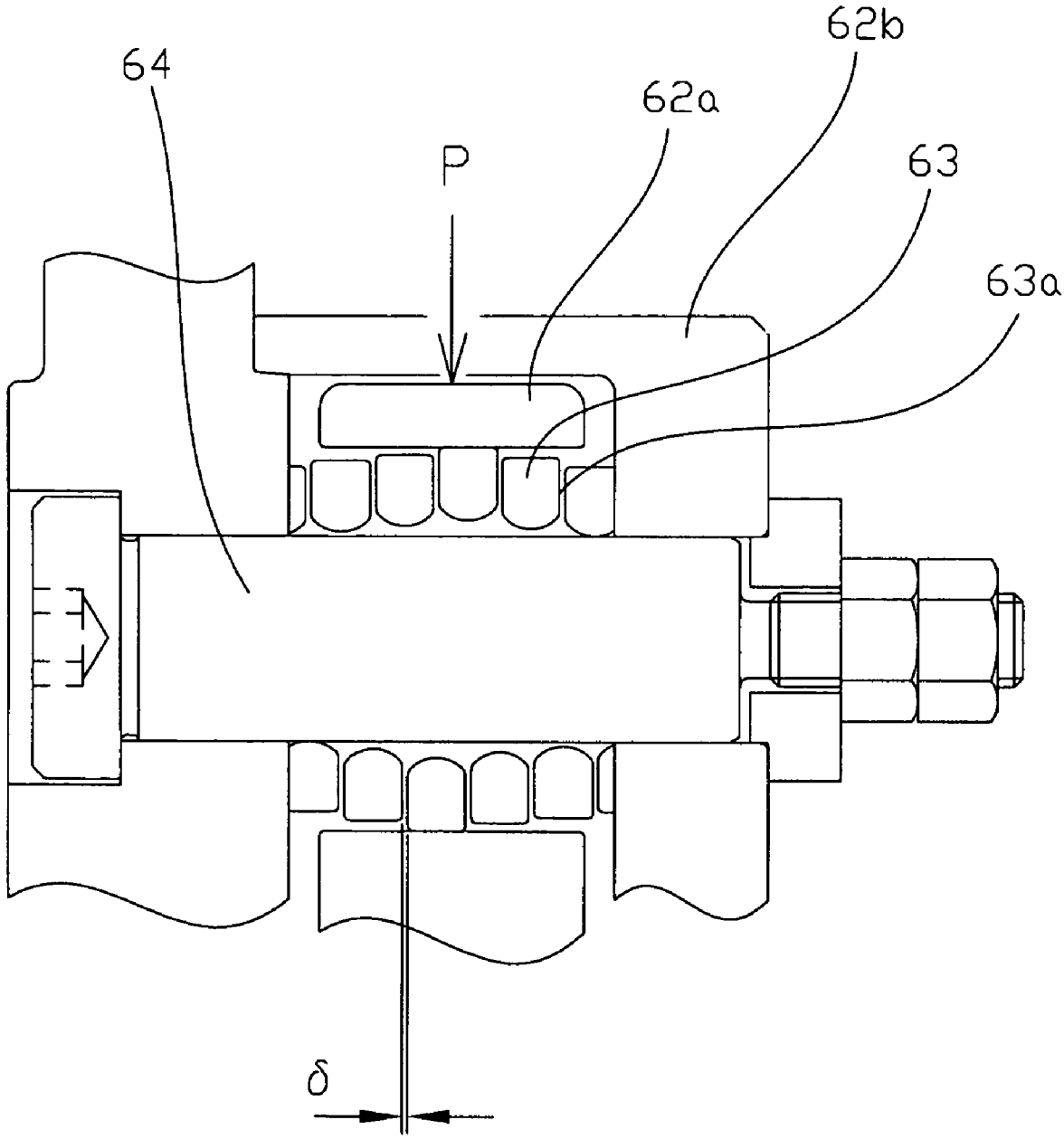
FIG. 6 is a sectional view of wire segments shown in FIG. 4.
Figure 7:
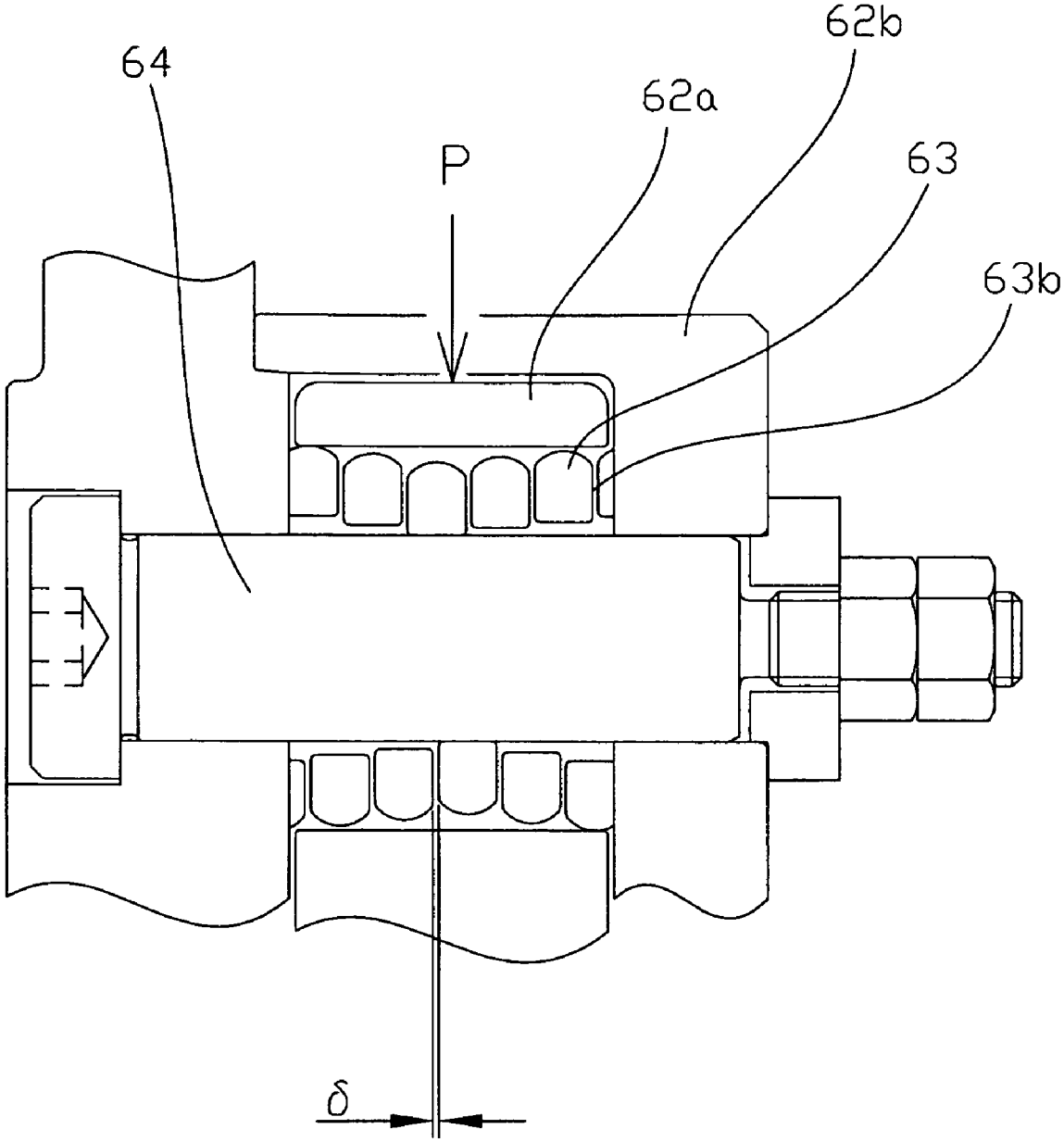
FIG. 7 is a sectional view of the wire segments shown in FIG. 4 similar to FIG. 6.

In the decanter type centrifugal separator 10 including the bowl 20 having an inside diameter of 740 mm, a driven side joint flange part 62*b* having a coil spring accommodating space and a U-shaped section in which ten supporting shafts 64 having the same diameter of 35 mm as the inside diameter of a coil spring 63 are arranged on the circumferential pitch circle of 256 mm, being equally spaced, and a drive side flange part 62*a* having holes 65 for holding the same coil springs 63 with an outside diameter of 65 mm that are accommodated in the middle space in the U-shaped flange part 62*b* on the same circumferential pitch circle of 256 mm are provided as shown in FIG. 4 and FIG. 5, as a transmission mechanism 61 especially for high load and high torque that is accommodated in the joint part 43 on the side of the screw conveyor 40 of the drive transmission shaft 51 between the differential gear unit 50 and the screw conveyor 40, and as a measure against torsional self-excited vibration of the screw conveyor 40 that can occur between the bowl 20 and the tip of the screw conveyor flight 42 through the treatment substances, such as PVC crystalline particles, or the like, especially at the time of operation under high load or for increased throughput, when the centrifugally precipitated particles (solid) are axially conveyed and dehydrated on the basis of the above-mentioned minute difference in speed of 40 to 80 $min^{-1}$ or so between the bowl 20 and the screw conveyor 40 inside it. As shown in FIG. 6 and FIG. 7, the coil spring 63 meets the specifications that the outside diameter is 65 mm; the inside diameter is 35 mm; the wire segments 63*a*, 63*b*; the number of effective turns is 4.5; the free length is 60 mm; the material is spring steel, such as SWOSC-V; and the wire segments 63*a* (the wire segments 63*b*) constituting the coil spring 63 have a section which is rectangular or is semi-rectangular, including a straight line at least at both sides perpendicular to the coil axial direction with a radial direction height of 12.3 mm and an axial direction width of 9.6 mm. In addition, the coil spring 63 is in the shape of a barrel-shaped coil which is convex at its middle portion in the axial direction, or of a hyperboloid-shaped coil which is concave at its middle portion, the assembled clearance for the outside diameter of the supporting shaft 64 for the coil spring inside diameter of 35 mm in the driven side joint flange part 62*b* having a U-shaped section, and that for the diameter of the holding hole 65 for the coil spring outside diameter of 65 mm in the drive side flange part 62*a* being set at minimum, and further the tight clearance δ in the axial direction for the coil spring 63 in the middle space in the U-shaped flange part 62*b* being adjusted to approximate 1.2 mm, preferably to under 1.2 mm, whereby a torque transmission mechanism 61 is achieved which provides flexibility in the direction of rotation, and affords the effect of damping the torsional self-excited vibration in small angles in the forward and backward directions generated during transmission of drive force by the frictional energy dissipation due to the axial direction surface contact between wire segments 63*a* (wire segments 63*b*) of the coil spring 63 under the lateral load imposed on the coil spring 63 in the torque transmission.

Because the torque transmission mechanism 61 is provided within the inside diameter of the screw conveyor hub 41, the size thereof is restricted, however, the diameter can be approximately 400 mm, and the axial length be 300 mm or so. In the state in which the above-mentioned coil spring has been assembled, the elasticity transmission torque is 2600 kg·m, and the torsion spring constant is $7.6\times10^5$ N·m/rad, thus an extremely high torque capacity being provided as a feature.

The driven side joint flange part 62*b* which has a U-shaped section and the drive side flange part 62*a* are generally made of iron, and preferably made of alloy steel. In addition, for lubrication of the axial direction surface contact portions between the wire segments 63*a* (the wire segments 63*b*) of the coil spring, the portion of the outside diameter of the supporting shaft 64 in the driven side joint flange part 62*b* that is to be contacted with the coil spring 63, and the portion of the holding hole 65 (65 mm diameter) in the drive side flange part 62*a* that is to be contacted with the coil spring 63, a small amount of molybdenum disulfide grease is used, whereby wear in long-term operation can be prevented.

Incorporation of the torque transmission mechanism 61 will eliminate the occurrence of torsional self-excited vibration, and torque fluctuation with peaks, thus the requirement for capacity of the differential gear unit 50 actually loaded will be reduced to as low as 600 to 800 kg·m, which can correspond to the normal transmission torque.

Figure 8:
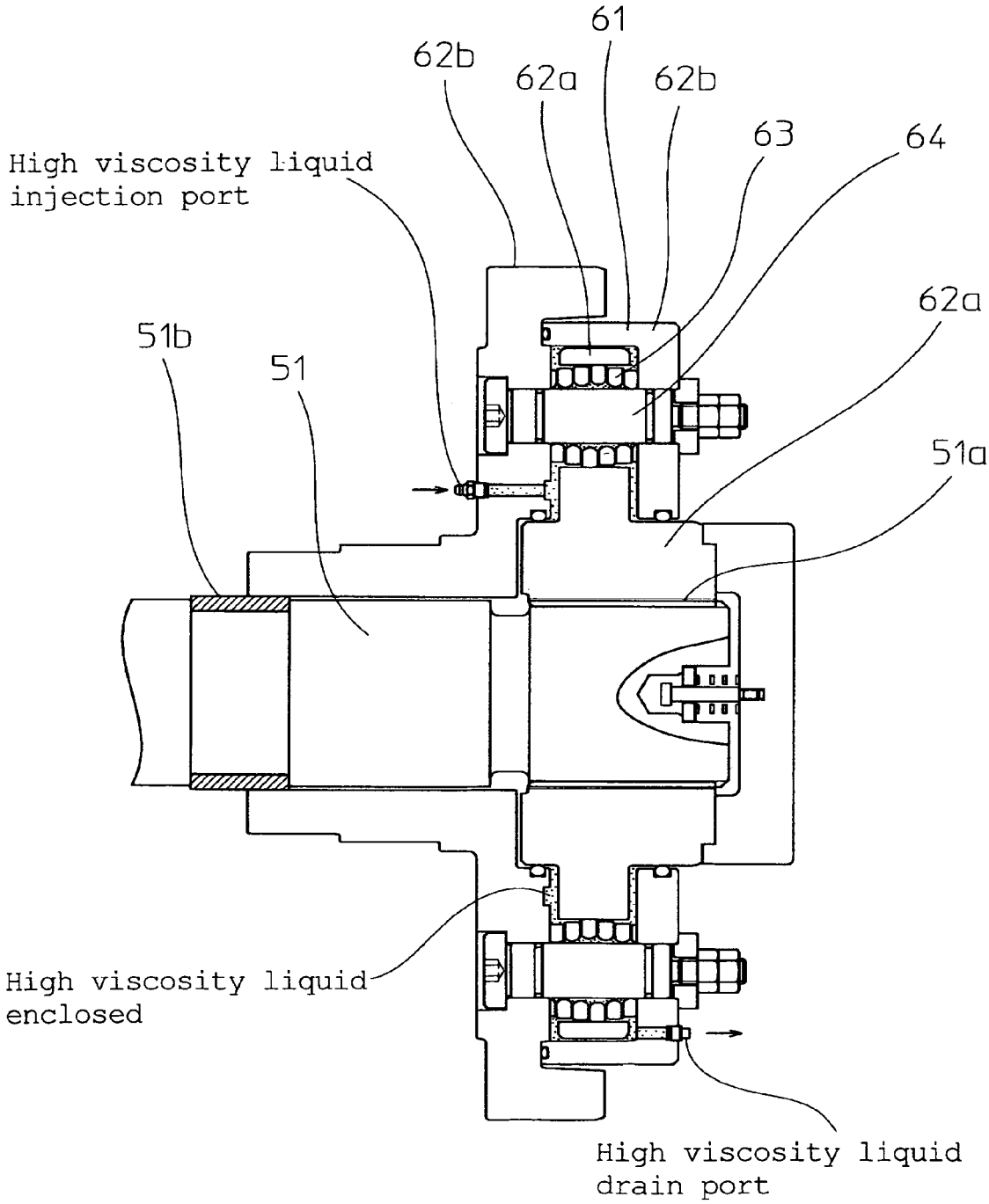
FIG. 8 is a partial side view illustrating a torque transmission mechanism of a decanter type centrifugal separator pertaining to a third embodiment of the present invention in detail.
Figure 9:
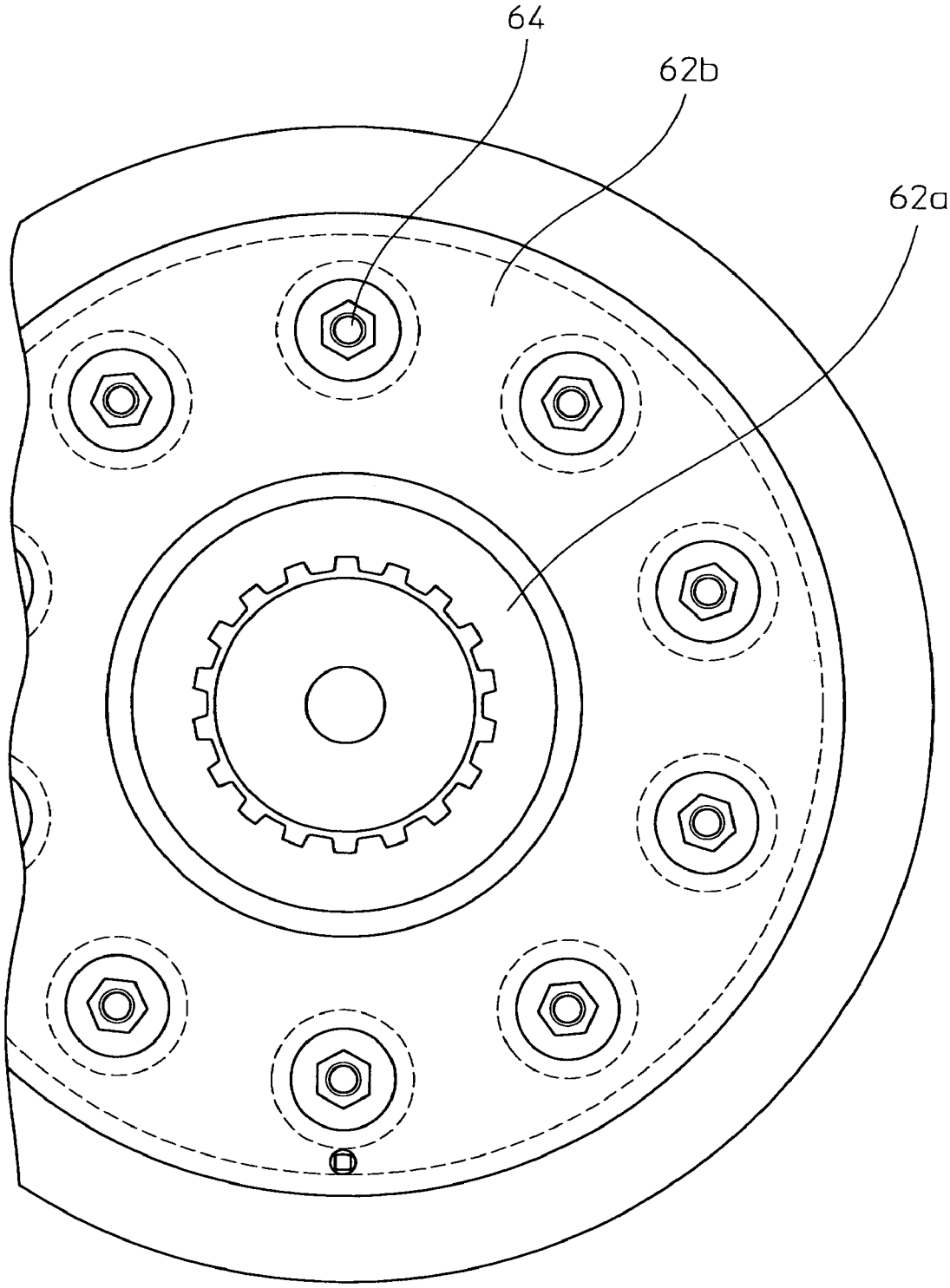
FIG. 9 is a partial front view illustrating the torque transmission mechanism of the decanter type centrifugal separator pertaining to the third embodiment of the present invention in detail.
Figure 10:
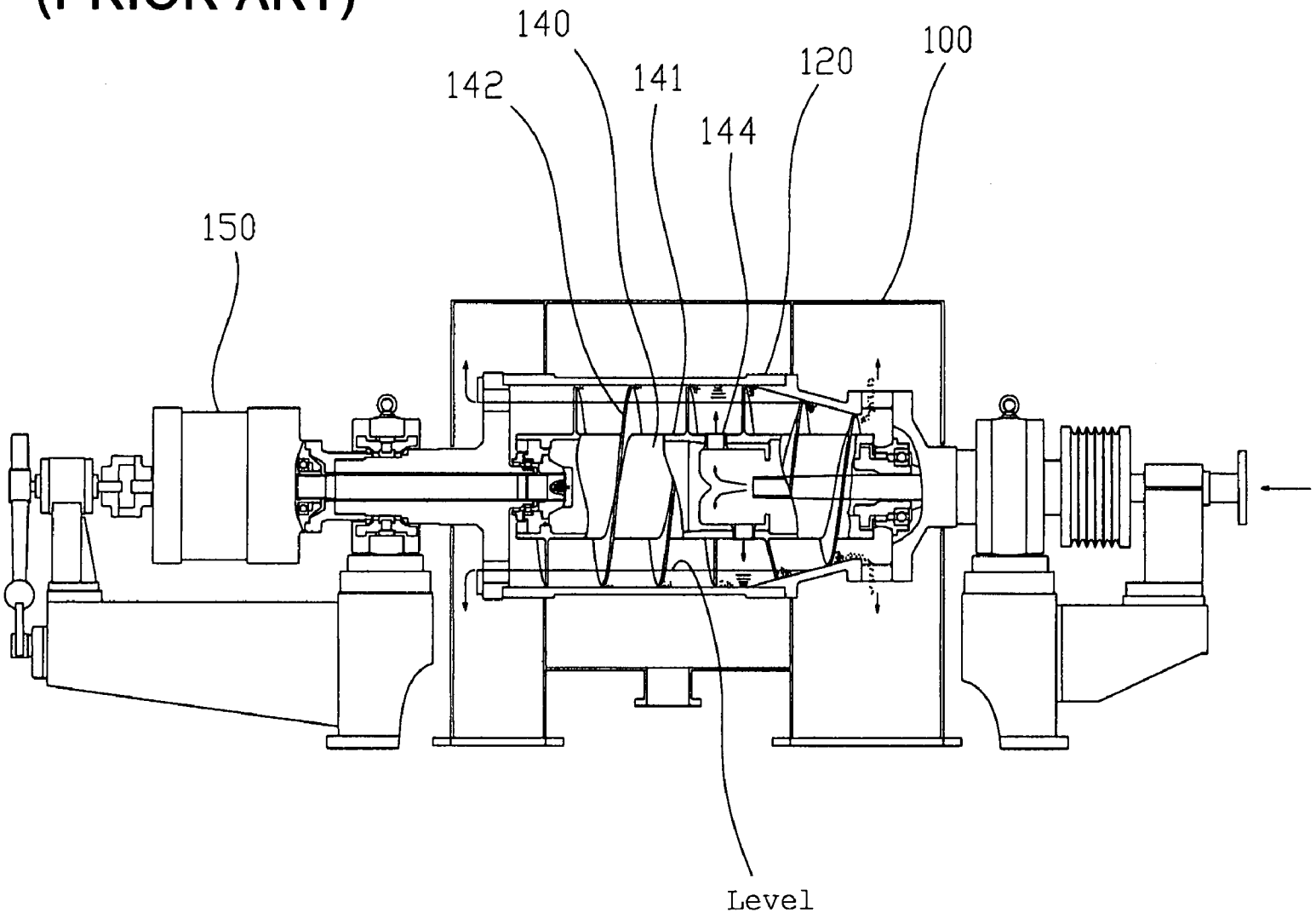
FIG.10 (PRIOR ART)
FIG. 10 is a side view illustrating an entire configuration of a conventional decanter type centrifugal separator.

FIG. 8 and FIG. 9 show a third embodiment of the present invention.

The same components as those in the first embodiment will be provided with the same reference numerals.

In the decanter type centrifugal separator 10 pertaining to the present embodiment, the entire assembly inside the torque transmission mechanism 60, 61 as given in the first embodiment or second embodiment that is included in the joint part 43 on the side of the screw conveyor 40 of the drive transmission shaft 51 between the differential gear unit 50 and the screw conveyor 40 is immersed in a high viscosity liquid, such as silicone oil, or the like, or a high viscosity substance, such as silicone rubber (initially liquid, but vulcanized into a gummy state as time elapses), or the like, as a measure against torsional self-excited vibration of the screw conveyor 40 that can occur between the bowl 20 and the tip of the screw conveyor flight 42 through the treatment substances, such as PVC crystalline particles, or the like, especially at the time of operation under high load or for increased throughput, when the centrifugally precipitated particles (solid) are axially conveyed and dehydrated on the basis of the above-mentioned minute difference in speed of 40 to 80 $min^{-1}$ or so between the bowl 20 and the screw conveyor 40 inside it, whereby the effect of damping the vibration can be increased.

INDUSTRIAL APPLICABILITY

It has been conventionally known that, as the throughput in separation and dehydration treatment of crystalline particles, such as those of PVC (polyvinyl chloride), terephthalic acid, or the like, or starch ground milk, or the like, is increased, chattering (torsional self-excited vibration) of the screw conveyor drive system, which is transmitted from the bowl to the differential gear unit, and from the differential gear unit to the screw conveyor through the drive transmission shaft, tends to be caused, however, in view of this situation, the present invention provides a decanter type centrifugal separator which has a torque transmission mechanism providing flexibility in the direction of rotation at the time of transmission of drive force for the joint part on the screw conveyor side of the drive transmission shaft between the differential gear unit and the screw conveyor, and enhancing the torsional vibration absorbing effect on the basis of a high damping factor, whereby the restriction or lowering of the treatment capacity due to the torsional self-excited vibration which has conventionally occurred in the separation and dehydration treatment of the above-mentioned substances can be avoided, which allows the inherent design maximum treatment capacity of the centrifugal separator to be exerted, which means that approximate 2 to 3 times the treatment capacity or higher compared to the conventional centrifugal separator for a given size and capacity can be achieved.

What is claimed is:

1. A decanter type centrifugal separator, comprising a bowl having a cylindrical part, a conical part, a separated liquid discharge dam part, and a dewatered solid discharge port;

a screw conveyor disposed in the bowl for axially conveying sedimentation solid, and arranged to be coaxial with the bowl to be rotatable at a speed different from that of the bowl;

a processed liquid feed means;

a separated liquid discharge port;

a solid discharge port;

a drive means; and a differential gear unit for generating a difference in speeds between the bowl and the screw conveyor, wherein there is provided a torque transmission mechanism including an elastic damping member for receiving a drive force transmission load on a torque transmission surface of a joint flange part formed in a joint part of a drive transmission shaft as a source of torsional vibration generation on a side of the screw conveyor between the differential gear unit and the screw conveyor in order to provide flexibility in a direction of rotation and an effect of damping with respect to a torsional self-excited vibration in small angles in forward and backward directions generated during transmission of drive force, thereby absorbing the torsional self-excited vibration of the screw conveyor generated during conveyance of treatment substances due to a minute difference in speeds between the bowl and the screw conveyor, wherein said elastic damping member is formed of coil springs;

said torque transmission mechanism disposed in the joint part of the drive transmission shaft on the side of the screw conveyor between the differential gear unit and the screw conveyor includes a driven side joint flange part having a U-shaped section in which a plurality of coil spring accommodating spaces and coil spring inside diameter supporting shafts are arranged on a circumferential pitch circle thereof, and a drive side flange part disposed in a middle space of the driven side joint flange part and having a plurality of outside diameter holding holes for the coil springs on the same circumferential pitch circle; and each of said coil springs is formed of wire segments having a rectangular section or flat planes at least at both sides thereof in a coil axial direction, and has a barrel-shaped coil shape which is convex at a middle portion thereof in the axial direction or a hyperboloid-shaped coil shape which is concave at a middle portion thereof;

so that by adjusting a clearance between an outer diameter of the coil spring inside diameter supporting shafts in the driven side joint flange part having the U-shaped section, and an inner diameter of the coil spring outside diameter holding holes in the drive side flange part, and by adjusting a coil spring tight clearance of a middle space of the driven side joint flange part in the axial direction, flexibility in the direction of rotation is provided, and the torsional self-excited vibration in the small angles in the forward and backward directions generated during the transmission of the drive force is damped with frictional energy generated through axial direction surface contact between the wire segments of the coil springs under a lateral load imposed on the coil springs during the torque transmission.

2. The decanter type centrifugal separator of claim 1, wherein an entire interior of said torque transmission mechanism formed in the joint part of the drive transmission shaft on the side of the screw conveyor between the differential gear unit and the screw conveyor is immersed in a high viscosity liquid or a high viscosity substance to increase a degree of damping of the self-excited vibration.

* * * * *